US006353945B1

(12) United States Patent
Jannetides

(10) Patent No.: US 6,353,945 B1
(45) Date of Patent: Mar. 12, 2002

(54) MULTI-POSITIONABLE BED

(76) Inventor: James N. Jannetides, 718 Tamenend, Fishers, IN (US) 46038

( * ) Notice: Subject to any disclaimer, the term of this patent is extended or adjusted under 35 U.S.C. 154(b) by 0 days.

(21) Appl. No.: 09/512,916

(22) Filed: Feb. 25, 2000

Related U.S. Application Data

(60) Provisional application No. 60/121,570, filed on Feb. 25, 1999.

(51) Int. Cl.[7] ..... A47C 19/20; A47C 19/22
(52) U.S. Cl. ..... 5/9.1; 5/8; 5/2.1
(58) Field of Search ..... 5/9.1, 8, 2.1, 37.1, 5/282.1, 11, 47, 48, 41

(56) References Cited

U.S. PATENT DOCUMENTS

| | | | | | |
|---|---|---|---|---|---|
| 665,535 | A | * | 1/1901 | Lein | 5/9.1 |
| 1,057,719 | A | * | 4/1913 | Farnsworth | 5/11 |
| 2,888,687 | A | * | 6/1959 | Lindsey | 5/2.1 |
| 3,011,180 | A | * | 12/1961 | Majeski | 5/9.1 |
| 3,246,347 | A | * | 4/1966 | Mason | 5/9.1 |
| 3,310,815 | A | * | 3/1967 | Griffin | 5/9.1 |
| 3,316,564 | A | * | 5/1967 | Rogers, Jr. | 5/9.1 |
| 3,338,648 | A | * | 8/1967 | Bannister | 5/8 X |
| 3,736,601 | A | * | 6/1973 | Riches | 5/47 X |
| 3,916,462 | A | * | 11/1975 | Riches | 5/9.1 |
| 3,952,342 | A | * | 4/1976 | Hart | 5/2.1 |
| 4,051,564 | A | * | 10/1977 | Gudish | 5/9.1 |
| 4,109,328 | A | * | 8/1978 | Mason | 5/2.1 |
| 4,139,077 | A | * | 2/1979 | Pena, Jr. | 5/8 X |
| 4,232,411 | A | * | 11/1980 | Speyer | 5/8 |
| 4,253,204 | A | * | 3/1981 | Tasaka | 5/2.1 |
| 4,312,086 | A | * | 1/1982 | Bianco | 5/2.1 |
| 4,555,821 | A | * | 12/1985 | Page | 5/9.1 |
| 5,233,707 | A | * | 8/1993 | Perkins | 5/8 |
| D412,070 | S | * | 7/1999 | Nesbit | D6/384 |
| 5,983,420 | A | * | 11/1999 | Tilley | 5/2.1 |
| 6,167,579 | B1 | * | 1/2001 | Kopish | 5/2.1 |

FOREIGN PATENT DOCUMENTS

| | | | | |
|---|---|---|---|---|
| GB | 1410440 | * | 10/1975 | 5/8 |
| GB | 2044085 A | * | 10/1980 | 5/9.1 |
| GB | 2137082 A | * | 10/1984 | 5/2.1 |

* cited by examiner

*Primary Examiner*—Robert G. Santos
(74) *Attorney, Agent, or Firm*—Bose McKinney & Evans LLP

(57) ABSTRACT

A bed assembly including a headboard, a footboard, a support frame and a mattress. The headboard, includes a plurality of equally spaced first frame coupling members, a lower portion having first mating members, and an upper portion having second mating members. The footboard includes a plurality of equally spaced second frame coupling members, a lower portion having third mating members, and an upper portion having fourth mating members;

The support frame includes a first headboard coupling member for engaging at least one of the first frame coupling members on the headboard; a first footboard coupling member for engaging at least one of the second frame coupling members on the footboard; first mattress support member; and a second mattress support member pivotally coupled to the first mattress support member.

The mattress is disposed generally on the first mattress support member and the second mattress support member.

11 Claims, 12 Drawing Sheets

MULTI-POSITIONABLE BED

This application claims benefit of Provisional Application No. 60/121,570 filed Feb. 25, 1999.

I. TECHNICAL FIELD OF THE INVENTION

The present invention relates to beds, and more particularly to a multi-positionable bunk bed assembly that includes a first and a second multi-positionable mattress frame assembly.

II. BACKGROUND OF THE INVENTION

Beds of various types have existed since man discovered that interposing a cushioning means between his or her body and the ground made sleeping more comfortable than lying directly on the ground. The conventional bed usually consists of a generally vertically disposed headboard member placed at the head of the bed, a generally vertically disposed footboard member placed at the foot of the bed, and a generally horizontally disposed mattress frame that extends there between, and is coupled to each of the headboard and footboard. A box spring usually overlays the mattress frame, and a mattress overlays the box spring. The generally planar upper surface of the mattress comprises the sleeping surface on which the user lays while sleeping.

A bunk bed is a variant on the traditional bed that has the advantage of providing two individual sleeping surfaces, while requiring no more floor space than a traditional bed having a single sleeping surface. A bunk bed usually consists of an especially tall, (e.g. five to seven feet high) vertically disposed headboard and footboard. A mattress frame is attached to each of the headboard and footboard and extends there between in a relatively low position, usually between one and two feet from the floor surface. A second mattress frame is disposed above the first mattress frame, and also extends between the headboard and footboard. The second mattress frame is connected to the headboard and footboard approximately four feet to six feet from the floor. A first mattress is placed over the first mattress frame, and a second mattress is placed over the second mattress frame. The spatial separation between the first and second mattress frames should be sufficient to ensure that enough space between the upper surface of the lower mattress and the bottom of the second mattress frame exists to provide a non-clastrophobic atmosphere for the user sleeping on the lower mattress.

A ladder can be attached to the upper mattress frame to enable the occupant of the upper mattress to climb up to the elevated second mattress. Alternately, one or both of the headboard and footboard can be designed to include ladder-like cross members to enable the occupant of the second (upper) bunk to climb up the cross-member to gain ingress to the mattress surface.

Various types of mattress frames can be employed with a bunk bed. Probably the most common mattress frame is a twin-sized steel mattress frame having four connected perimetral steel rails that define a generally rectangular aperture. One or more cross members (or alternately a chain-link like web of metal wire) can extend between the perimetral rails to support the middle of the mattress. Further, some bunk beds contain double-bed sized frames, and one particularly popular form of bunk bed includes a double-sized lower mattress frame, and a twin-sized upper mattress frame.

A further known variant is to replace the lower mattress frame with a so-called "futon" frame. A futon frame generally comprises a jointed, double-bed sized mattress frame that can be moved between a generally planar "bed" position, and a "couch position," where one of the two jointed sections of the mattress frame is disposed in a plane generally perpendicular to the other section of the jointed mattress frame to form a back rest.

A particularly flexible, bendable mattress is placed over the frame so that when the futon frame is placed in its couch position, a portion of the mattress rests against the back rest portion of the frame. When so configured, the mattress frame and mattress take on the general configuration of a couch having a back rest. Futon-type mattress frames provide the user with more flexibility than conventional, uni-positional frames, because, when the mattress frame is in its "couch" position, it provides a more comfortable seating surface than a conventional planar mattress.

The primary advantage of a bunk-type bed is that it provides two individual sleeping surfaces, while requiring the floor space of only a traditional single bed. As such, a bunk bed has particular applicability in situations where it is desirable to maximize useable floor space, and to minimize the floor space within a room that is occupied by the bed.

The usual domain of bunk-type beds are children's rooms, college dormitory rooms, and institutional dormitories, such as army barracks and jails. Older persons usually do not prefer bunk beds because of the inconvenience faced by the occupant of the upper bunk gaining ingress to, and egress from the upper bunk. However, bunk beds have gained an especially large amount of popularity for younger users in space-confined areas, such as college students in dormitories.

Typically, a college dormitory room is no larger than a standard bedroom. Notwithstanding the space constraints, a college dormitory room usually comprises the primary living space of two people, and serves, effectively, as a small studio apartment. To make the dorm room feel more like home, students often cram several articles of furniture and appliances within the small space, such as a pair of desks, upon which the students can study and prepare their homework assignments; a refrigerator and/or microwave oven for enabling the student to cook snacks such as pizza, and keep beverages cold; a computer stand on which to place the student's various computer components, and, of course, a television set. The limited area of most dorm rooms places floor space at a premium. As such, bunk beds have gained significant popularity, as the floor space freed-up by the use of a bunk bed helps to make a dorm room feel much less crowded.

As alluded to above, a typical college student uses his dorm room not only for sleeping, but also for entertaining herself and her guests. The small amount of floor space available in most dorm rooms prevents the room from comfortably accommodating two beds and a couch. Even with bunk beds, many dorm rooms do not have enough space to accommodate a couch, or more than one comfortable guest seating chair. Although a bed can serve as a seating surface, sitting on a planar bed is usually uncomfortable for long periods of time, as a traditional bed provides no back support. As such, one problem associated with traditional beds, and even traditional bunk beds, is that while they do provide a comfortable surface for sleeping, they provide a poor surface for sitting, and do not function well when the user desires a seating surface on which to sit while reading, watching television, or entertaining guests.

It is therefore one object of the present invention to provide a bunk bed that not only can provide a generally planar surface for sleeping, but that also can provide a comfortable seating surface for the user.

One problem faced by college administrators is attracting students to, and retaining students within their particular institutions. One feature used by administrators to attract students is the quality of living space provided for the students by the university. Many administrators believe that the attractiveness (or lack thereof) of the students' dormitory is a significant factor in a student's decision to attend a particular institution. As such, the incorporation of a bunk bed into a dormitory room can help to make the dormitory room "feel" larger than a room with two twin beds, thus making the dormitory more attractive to a potential student by making it feel less confining and claustrophobic. Nonetheless, as almost all colleges offer bunk beds to their students, the mere provision of a bunk bed in a dormitory room does not provide the institution with any significant edge over its competitors.

Another problem faced by dormitory administrators is providing dormitory furniture that is sufficiently flexible to accommodate a wide-range of tastes and personal preferences of the student body. Although many students prefer bunk beds because of the increased amount of floor space they provide, some students do not like bunk beds, either because they do not enjoy sleeping while elevated high off the floor, or alternately, because they do not wish to suffer the inconvenience associated with the climb up into, and the climb down out of a bunk bed.

One obvious solution to this problem is for the university to maintain a large amount of bunk beds, and a large amount of traditional, single twin beds in its inventory. Unfortunately, this obvious solution has some obvious drawbacks. It is difficult to predict the exact mix of students who will prefer bunk beds as compared to twin single beds. Thus, in order to accommodate all of the students, the university would be required to have a significantly greater than necessary number of beds, so that the university could provide each pair of students with the particular desired type of bed arrangement. The excess inventory required to accommodate all students results in additional expense to the dormitory administrator and the institution.

This problem is further complicated by the fact that students enjoy variation in their room arrangements. As such, a student may desire to employ a pair of single, side-by-side-type twin beds for part of her stay at the dormitory, but employ bunk beds during other times. With traditional twin beds and bunk beds, accommodating these changing desires would require the student or the university to spend a substantial amount of time interchanging bed components.

Therefore, another object of the present invention is to provide a bed system that is sufficiently flexible so that it is capable of being used both as a bunk bed, and as a pair of side-by-side traditional twin beds.

A further problem faced by dormitory administrators is that students have differing preferences relating to the height at which they prefer to place their beds off the floor surface. Some students prefer having the lower bed frame and mattress disposed very close to the ground, and the upper bed frame relatively high, because to do so, when using bunk beds, maximizes the "head space" between the upper surface of the lower mattress and the bottom surface of the frame of the upper bed frame. This additional head space enables the student to have more room to sit upright on the lower bunk, and also helps to make the lower bunk space seem less claustrophobic. However, some prefer the upper bed to be placed at a relatively lower level, as it makes the student's climb into the upper bunk less difficult.

As another variation, some students prefer a relatively raised lower bed frame to provide extra space between the lower bed frame and the floor. This extra space underneath the lower bed frame can then be used for the storage of books, suitcases, sports equipment and other personal items. Some known bed frames are designed to provide enough space under the lower bed frame to enable a furniture piece consisting of an extremely low (e.g. one or two drawer's high) chest of drawers to be placed under the lower bed frame. Unfortunately, many traditional known bunk beds do not accommodate this variation in tastes.

It is therefore a further object of the present invention to provide a bedding system that permits the user to vary the height of the bed frames to accommodate the user's particular taste and preferences.

III. SUMMARY OF THE INVENTION

In accordance with the present invention, a bunk bed assembly is disclosed that comprises a first bed assembly and a second bed assembly. The first and second bed assemblies each include a headboard and a footboard. The headboard of the first bed assembly is removably mateably coupled to the headboard of the second bed assembly; and the footboard of the first bed assembly is removably mateably coupled to the footboard of the second bed assembly. Through this removable mateable coupling, the first and second bed assemblies can be mateably coupled together in each of a first, bunk bed position wherein the second bed assembly is positioned on top of the first bed assembly; and a separated bed position wherein the first bed assembly is detached from the second bed assembly, to permit the first and second bed assemblies to be positioned independently with respect to each other.

Each of the headboards of the first and second bed assemblies includes a first and second spaced, vertical array of bed frame receiving members. Similarly, each of the footboards of the first and second bed assemblies includes a first and second vertical array of spaced, bed frame receiving members. A first bed frame is removably attachable to the first headboard and the first footboard. A second bed frame is removably attachable to the second headboard and footboard.

Each of the first and second bed frames includes a pair of spaced, headboard engaging members for selectively, removably engaging the bed frame receiving members of the headboards. The bed frames also include a pair of spaced footboard engaging members for selectively, removably engaging the frame receiving members of the footboards.

One feature of the present invention is that it includes a first and second vertical array of spaced bed frame receiving members. This feature has the advantage of enabling the bed frame assembly to be adjustably positioned upon the headboards and footboards, to enable the user to vary the height of the bed frame from the floor. By doing so, the user can better adjust the bed to suit his particular preferences, and to achieve a wider variety of configurations.

A second feature of the present invention is that each of the bed frame assemblies is movable between a generally planar bed position, and an angled couch position. When in the bed position, the bed frame assembly has a width that approximates that of a double bed. This feature has several advantages. First, this feature permits a bed frame having a footprint width of a twin-sized bed to serve as a double bed better suited for accommodating additional sleeping space, or more than one occupant within the bed. Another advantage obtained by this feature is that each of the two bed assemblies can be moved independently between a bed position and a couch position. This independent movement provides the user with a great deal of flexibility with respect to the configurations of the bed.

For example, if the bed is used by a single person, that single person may wish to keep one of the bed frame assemblies permanently in its planar bed position, to provide a sleeping surface, while keeping the other bed frame assembly in its couch position to provide a comfortable seating surface for entertaining guests, watching television or reading. When this feature is combined with the ability of the first and second bed frames to be separated, an even wider array of configurations is available. As will be discussed in more detail below, the bed frame of the present invention can provide "stadium seating" by varying the position of the two bed frame assemblies on their respective posts, and placing both bed frame assemblies in their couch position. The relatively higher bed frame assembly can be placed behind the relatively lower bed frame assembly, to permit those sitting in the relatively higher, rearwardly positioned bed frame assembly to easily see over the heads of those sitting in front of them on the relatively lower, forwardly positioned bed frame assembly.

These and other features of the present invention will become apparent to those skilled in the art upon a review of the drawings and the detailed description, presented below, that describe the best mode of practicing the invention as perceived presently by the applicant.

IV. BRIEF DESCRIPTION OF THE DRAWINGS

Figure 12:
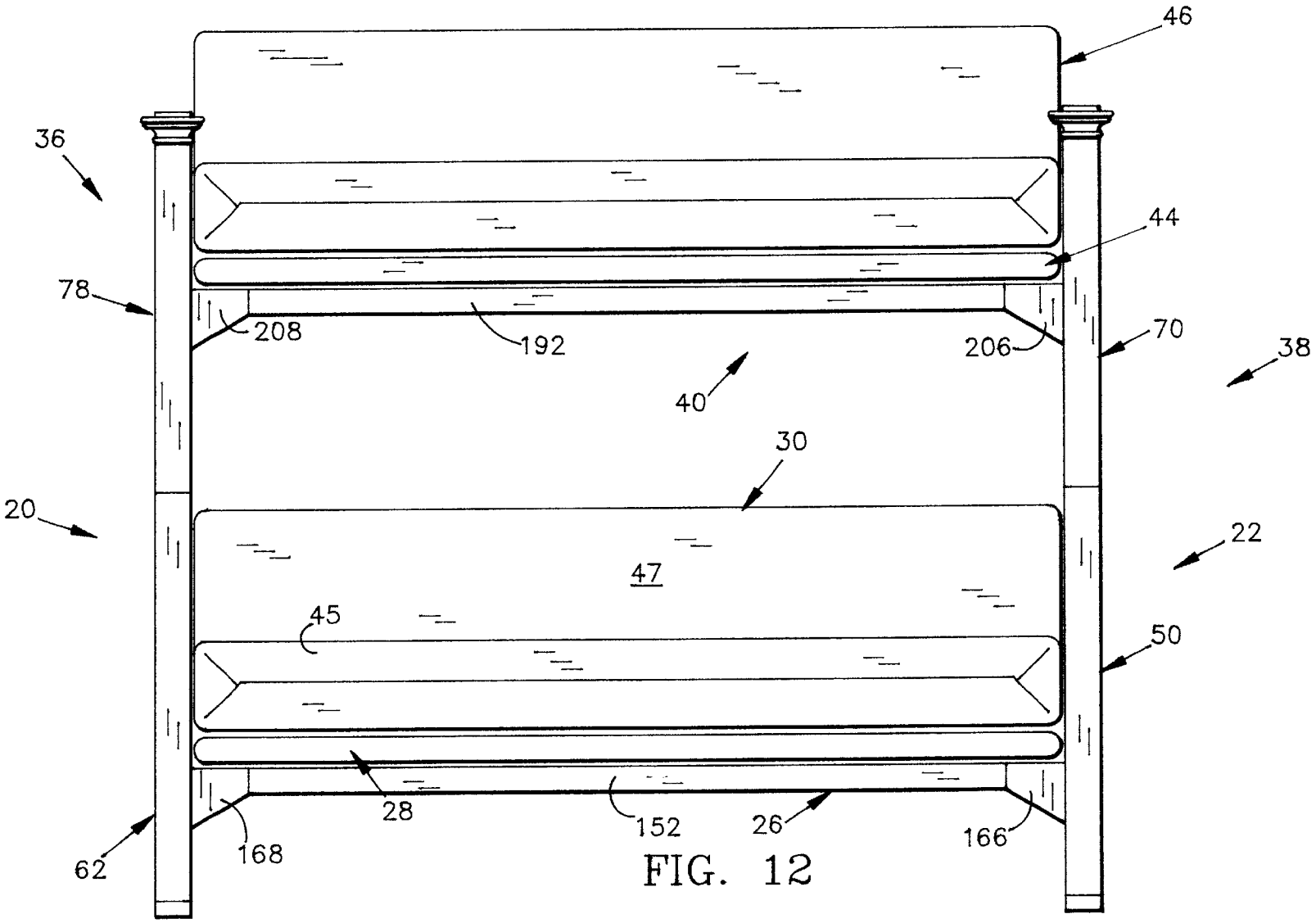
Figure 13:
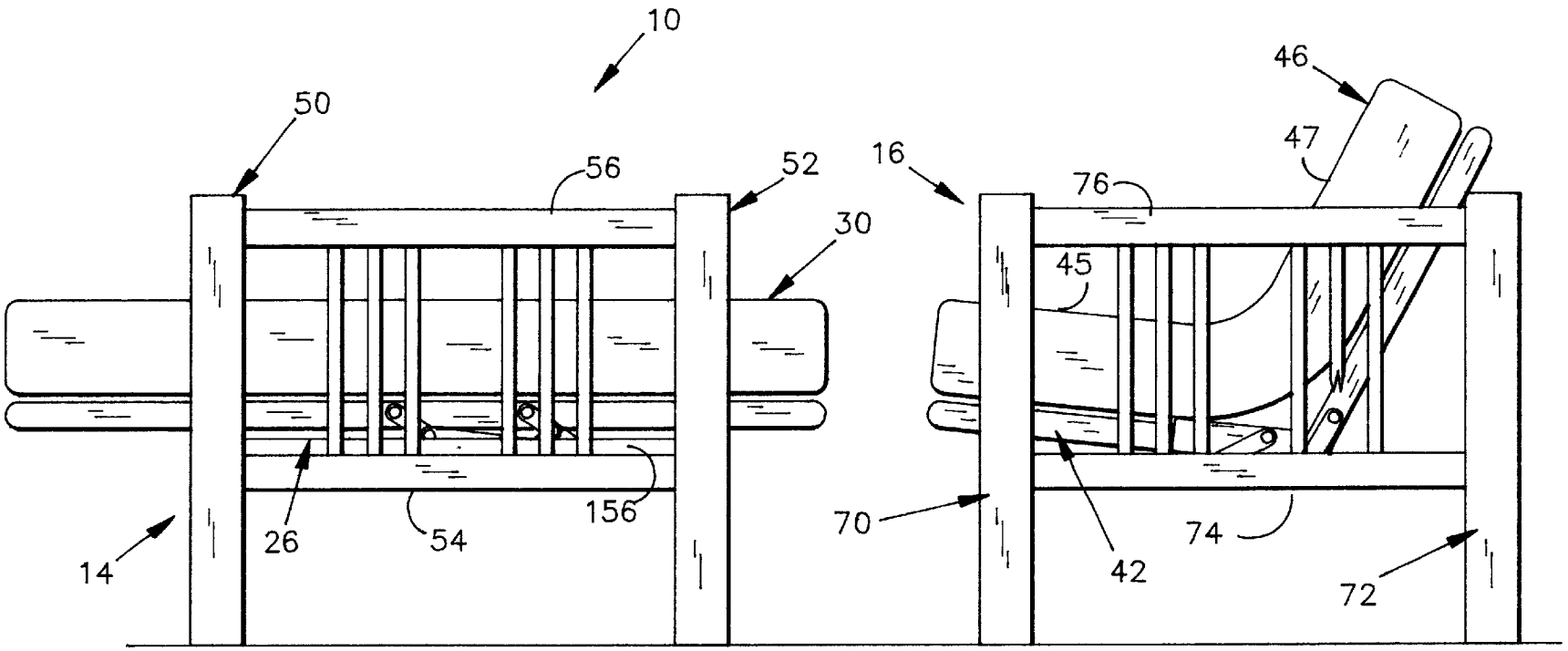
Figure 14:
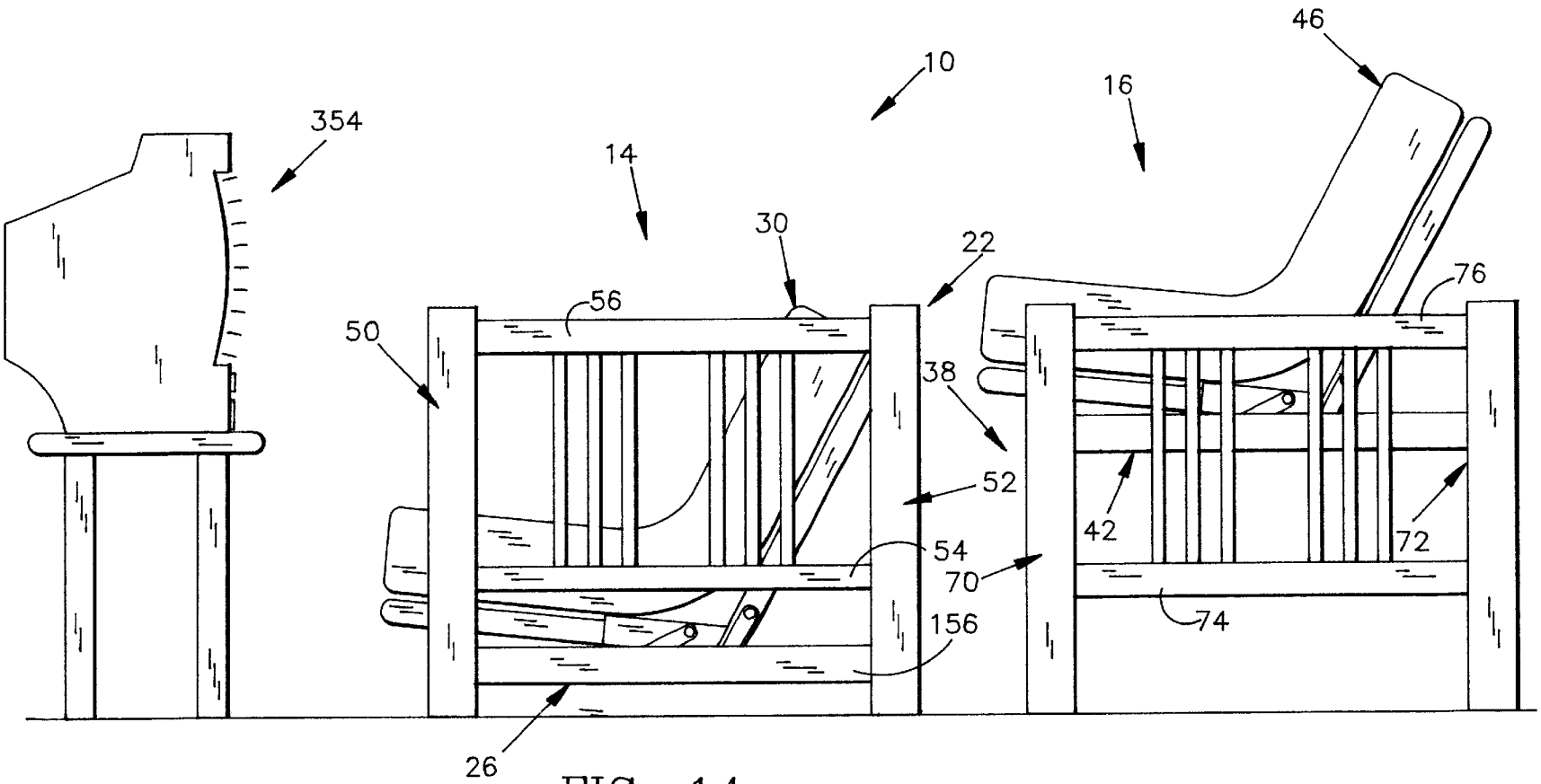
Figure 15:
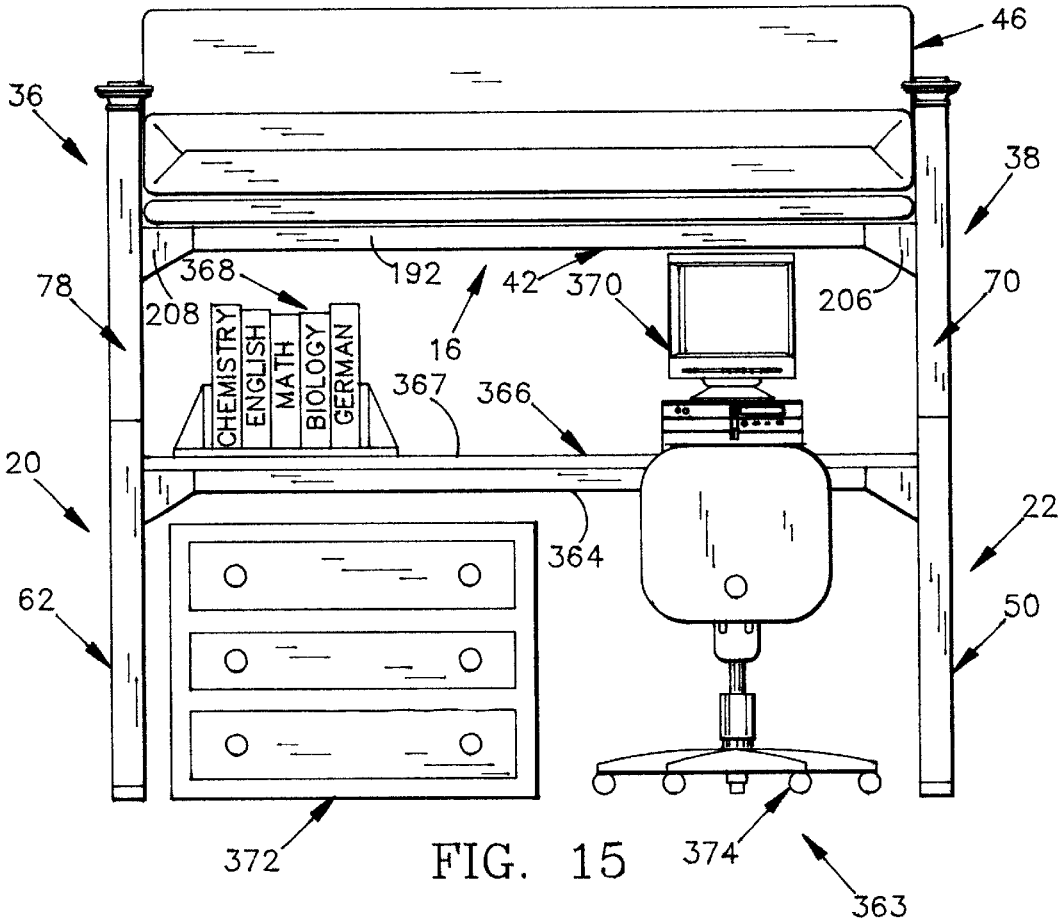
Figure 16:
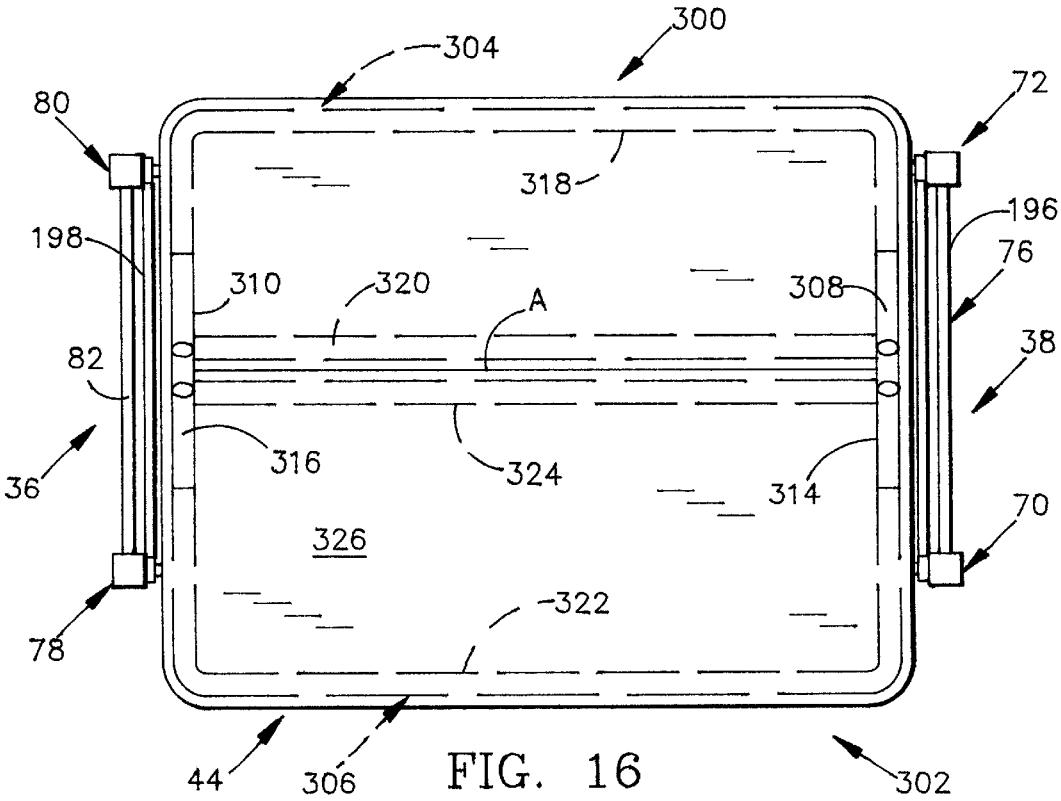

FIG. 12 is a front view of the bed of the present invention showing the first bed frame placed in a relatively low position on the headboards and footboards, and the second bed frame assembly placed in an elevated position high upon the headboards and footboards, to maximize the distance between the first and second bed frames, to thereby maximize the "head room" provided to one using the first bed assembly;

FIG. 13 is a side view of a first and second bed assemblies in their non-stacked, or separated positions, wherein the first bed frame assembly is in its generally planar position, and the second bed frame assembly is in its angled or "couch" position;

FIG. 14 is a side view of the first and second bed assemblies in their separated, or non-stacked position, wherein the bed frame assemblies of each bed assembly is configured in its couch position, to provide stadium-height seating, for viewing a television set;

FIG. 15 is an alternate embodiment of the present invention where in the first bed assembly has been replaced by a desk; and FIG. 16 is a top view of the present invention, showing the bed frame assembly in its planar position, and the mattress removed therefrom.

V. DETAILED DESCRIPTION OF THE INVENTION

The bunk bed 10 of the present invention includes a first (lower) bed assembly 14, and a second (upper) bed assembly 16. First bed assembly 14 includes a headboard 20 for supporting the head end of first bed assembly 14, and a footboard 22 for supporting the foot end of first bed assembly 14. A mattress frame assembly 24 extends longitudinally between headboard 20 and footboard 22 and includes a frame 26, that is coupled at its head end to headboard 20, and at its foot end to footboard 22. Frame 26 supports a mattress support 28, that, in bunk bed 10 of the present invention serves as a box spring. As will be described in more detail below, mattress support 28 is articulated, and includes two, generally planar portions joined together by a pair of hinges, that form a support on which a mattress 30 can be placed to overlay mattress support 28.

Certain direction-specific terms, such as "upper", "lower", "headboard" and "footboard" will be used in this application for purposes of clarity of the description. However, it should be understood that these direction-specific terms should not be construed as being limiting. As will be described in more detail below, for example, the upper 14 and lower 16 bed assemblies are configured so that lower bed assembly 14 can be placed above upper bed assembly 16, and thus, lower bed assembly 14 becomes the upper bed assembly. Additionally, as shown in FIG. 12, lower bed assembly 14 and upper bed assembly 16 can each be placed on the same floor surface so that the two bed assemblies 14, 16 are at the same level, and as such, neither serves as either an "upper" or "lower" bed assembly. Further, headboard 20 and footboard 22 can be designed to be generally identical in configuration, and therefore, be interchangeable with each other.

Second (upper) bed assembly 16 includes a generally vertically disposed, laterally extending headboard 36, and a generally laterally extending, vertically disposed footboard 38. Headboard 36 and footboard 38 extend in generally parallel planes. A mattress frame assembly 40 extends generally longitudinally between headboard 36 and footboard 38. The mattress frame assembly 40 includes a generally longitudinally extending frame 42 that is coupled at one end to headboard 36, and at another end to footboard 38. Frame 42 supports an articulated mattress support 44, that is generally identical to mattress support 28. A mattress 46 overlays mattress support 44.

Figure 1:
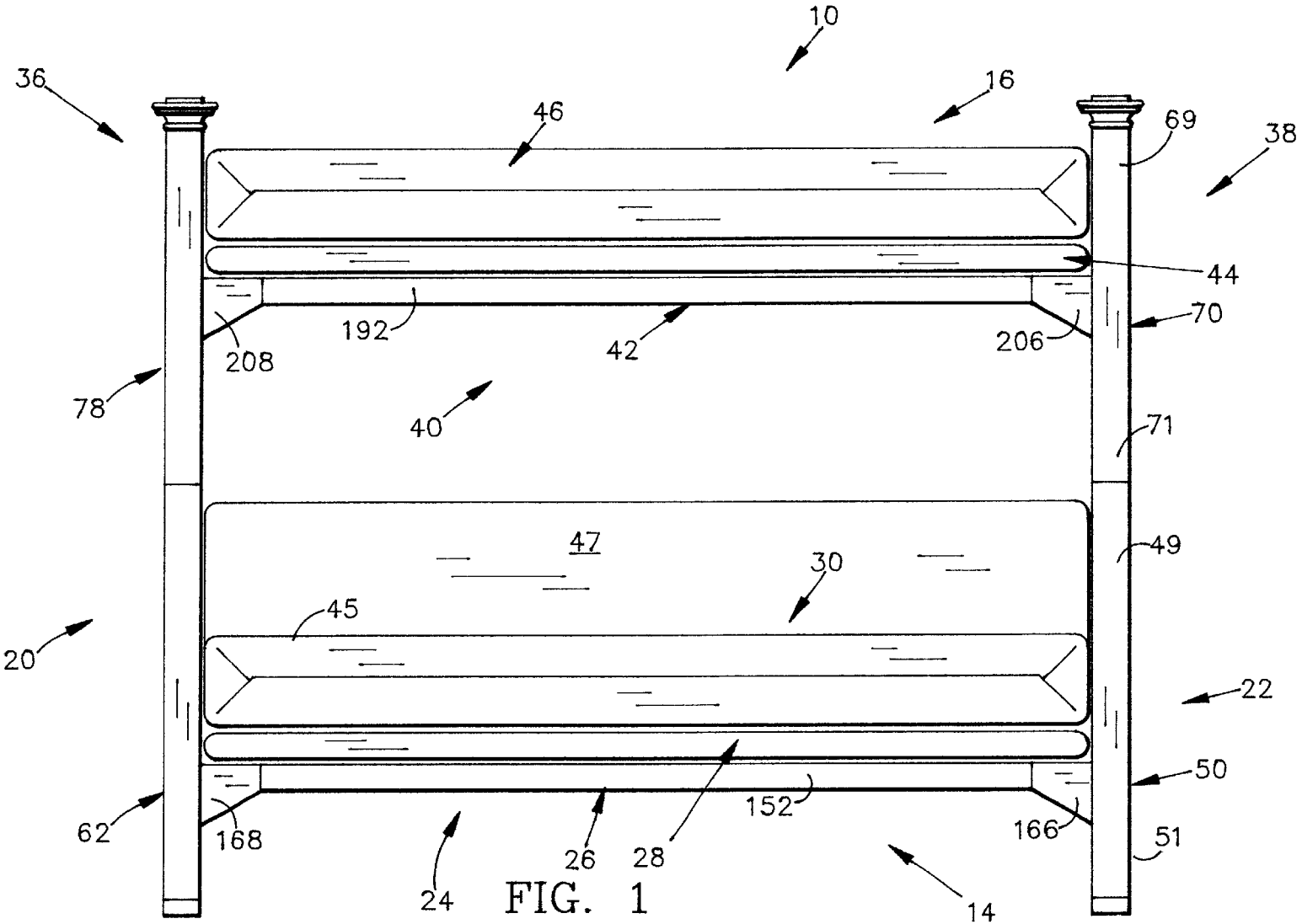
FIG. 1 is a front elevation view of the bed of the present invention, showing the first (lower) bed frame assembly in its angled or "couch" position, and the second (upper) bed frame assembly in its planar or "bed" position.
Figure 2:
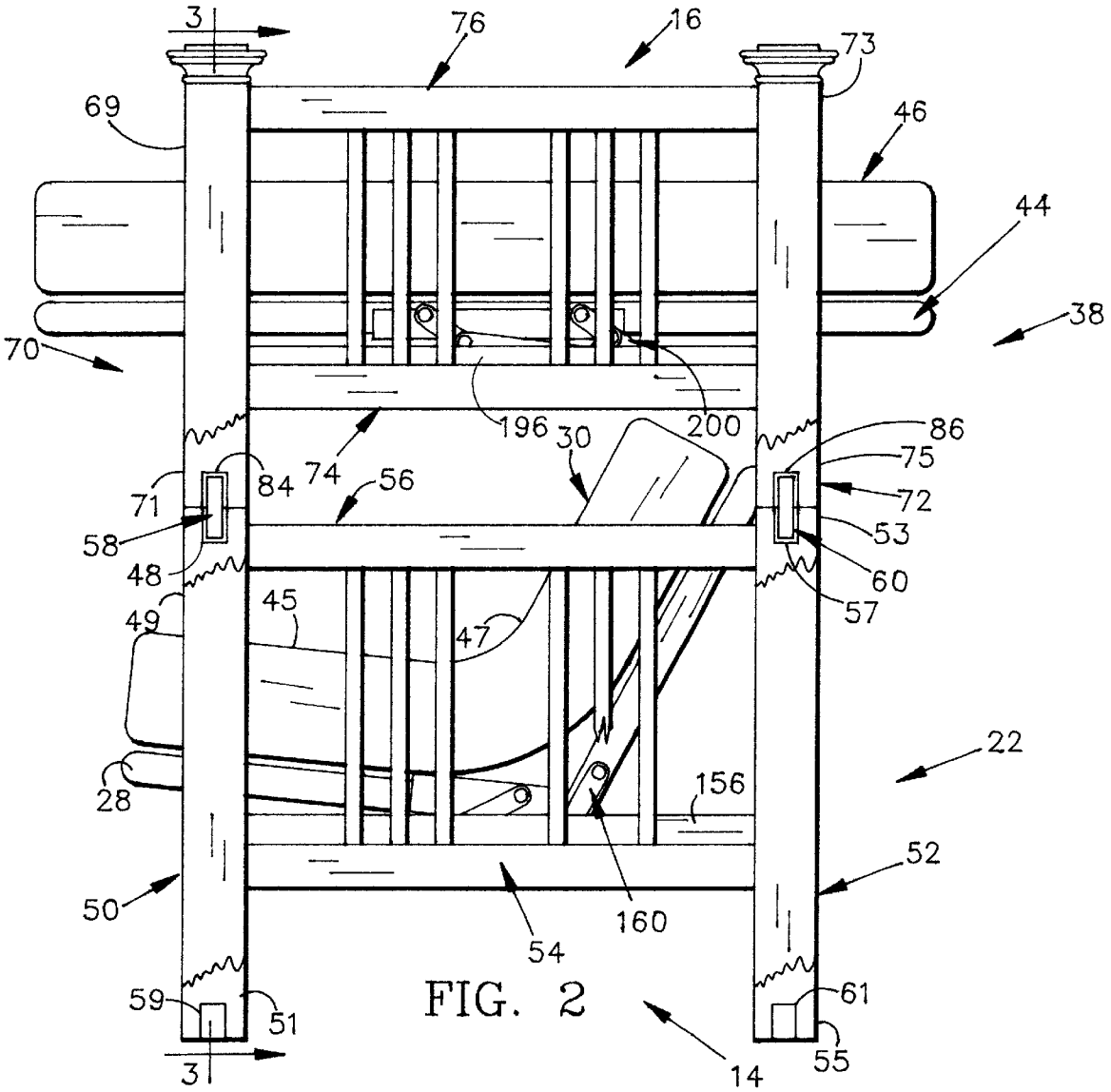
FIG. 2 is a side elevation view of the bed of the present invention, wherein the bed frame assemblies are configured similarly to that shown in FIG. 1.
Figure 3:
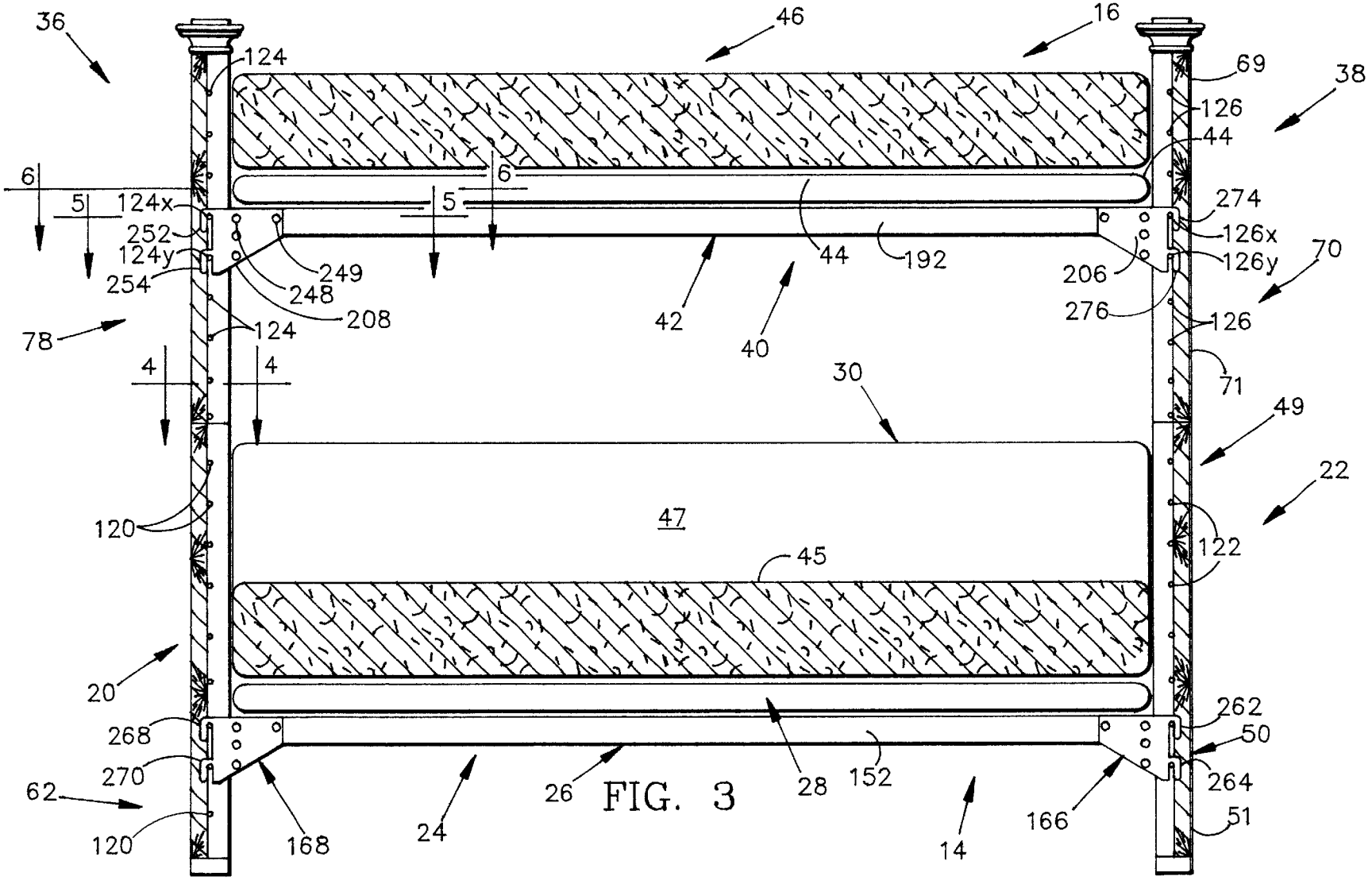
FIG. 3 is a sectional view taken generally along lines 3—3 of FIG. 2.

Mattress supports 28, 44 are movable between a generally planar "bed" position, and an angled "couch" position. In FIGS. 1–3, mattress support 44 of the upper bed frame assembly 40 is shown in its planar, bed position wherein mattress 46 is configured to have a generally planar upper surface that, in one embodiment, is approximately the same size as a "double" bed. On the other hand, mattress support 28 of first frame assembly 24 is shown in its angled, couch position, wherein mattress 30 which overlays support 28 is bent, into two intersecting planes that comprise a seat rest portion 45, upon which the user can rest his bottom, and a back rest portion 47 against which the user can rest his back.

As best shown in FIG. 2, footboard 22 of lower bed assembly 14 includes a first vertically extending post 50 having an upper end 49 and a lower end 51; and a second vertically extending post member 52 disposed in a parallel, spaced relation to the first vertically disposed post 50. Second vertically extending post 52 includes an upper end 53 and a lower end 55. A first and a second crossbar member, 54, 56 respectively, extend laterally, parallel to each other, between first 50 and second 52 vertically extending posts.

Although posts 50, 52 and crossbars 54, 56 can be made of a wide variety of structurally sturdy materials, such as wood, plastic and metal, aesthetic considerations dictate that wood members, such as 4" by 4" posts be used for vertically extending posts 50, 52, and that wood slat members (e.g. 1"×4" slats) be used for first and second crossbars 54, 56. Although wooden posts are preferable for use in residential settings, metal posts and cross bar members may be more desirable in heavy-duty institutional settings such as prisons, army barracks and summer camp cabins. It will also be appreciated that the particular appearance of posts 50, 52 and cross bar members 54, 56, and in fact, the particular appearance of headboard 20 and footboard 22 is governed largely by aesthetic considerations. Just as with prior art beds, the headboard, footboard, and components thereof of the present invention may take on a wide variety of different appearances.

Referring to FIG. 2, footboard 22 further includes a stud receiving aperture 48 that extends downwardly from an upper surface in upper end 49 of post 50 and a stud receiving aperture 57 that extends downwardly from an upper surface in upper end 53 of post 52. A stud member 58 extends upwardly within post 50, with a top portion of stud member 58 extending outwardly from the upper surface of upper end 49 of post 50, and a lower portion of stud member 58 disposed within stud receiving aperture 48 of post 50. Similarly, a second stud member 60 is disposed in stud receiving aperture 57 of second post 52. A lower portion of stud member 60 is disposed within stud receiving aperture 57 and an upper end of stud member 60 extends outwardly from the upper surface in upper end 53 of post 52. First and second stud member 58, 60 form part of the coupling means for coupling first bed assembly 14 to second bed assembly 16 so that assemblies 14, 16 may be fixedly positioned with respect to each other in a "stacked" position, as shown in FIGS. 1–3. First and second stud receiving apertures 59, 61 are formed in lower ends 51, 61, respectively, of first and second footboard posts 50, 52. Stud receiving apertures 59, 61 each is provided for receiving a stud member (not shown) when first bed assembly 14 is used as the "upper" bed assembly, and second bed assembly 16 is used as a lower bed assembly, generally opposite to the way it is shown in the drawings.

Those skilled in the art will realize that alternative methods may be implemented to couple first and second bed assemblies 14, 16. One example is to provide a reduced portion in upper ends 49, 53 of posts 50, 52 and a mating cavity in lower ends 51, 55 of posts 50, 52. Specifically, with post 50 being a 4×4, the reduced portion in upper end 49 may be a 2×2 cross section and extending 2 inches below the upper surface of post 50. The mating cavity in lower end 51 of post 50 is designed to receive the reduced portion of upper end 49.

Referring to FIG. 1, headboard 20 of first bed assembly 14 can be identical to footboard 22, and also includes a pair of spaced, generally parallel, vertically extending first and second post members 62, (not shown). Additionally, headboard 20 can include first and second cross bars that are generally identical to the first and second cross bars 54, 56 of footboard 22.

Footboard 38 of second bed assembly 16 is generally similar, and preferably identical to footboard 22 of the first bed assembly 14. Footboard 38 includes first 70 and second 72 vertically extending posts. First and second posts 70, 72 of footboard 38 of second bed assembly 16 should be generally identical in size, configuration, and spacing to first and second posts 50, 52 of footboard 22 of lower bed assembly 14, so that when first and second bed assemblies 14, 16 are assembled into their bunk bed configuration, as shown in FIGS. 1–3, first footboard posts 50, 70 are co-linear, and second footboard posts 52, 72 are also co-linear.

First vertically extending post 70 includes an upper end 69 and a lower end 71. Second vertically extending post 72 also includes an upper end 73 and a lower end 75. First and second cross members 74, 76 can be generally identical to first and second cross members 54, 56 of lower bed assembly 14 and are provided to extend between first and second posts, 70, 72. Cross members 74, 76 provide structural support to bed frame assembly 16, and maintain first and second posts, 70, 72 in a parallel, upright configuration.

As best shown in FIG. 16, headboard 36 also includes first and second generally parallel, upstanding post members 78, 80, and first and second crossbar members (not shown), 82. Crossbar members (not shown), 82 are generally similar, if not identical, to crossbar members 74, 76 of footboard 38, and serve the same purpose.

Returning now to FIG. 2, lower ends 71, 75 of respective first and second posts 70, 72, each includes a generally vertically extending stud receiving aperture 84, 86 respectively. Stud receiving apertures 84, 86 are sized and positioned for receiving the upstanding studs 58, 60 which are disposed within first and second posts 50, 52 of lower bed assembly 14. The cross sectional configuration of stud receiving apertures 84, 86 depends largely upon the cross sectional shape of stud members 58, 60. For example, if stud members 58, 60 are oval in cross section, stud receiving apertures 84, 86 should also be oval in cross section, and have a diameter slightly greater than the diameter of the studs 58, 60, so that the stud receiving apertures 84, 86 can snugly, slidably receive stud members 58, 60 therein. Similarly, stud receiving apertures 48, 57 of lower bed assembly 14 should match the cross sectional configuration of stud receiving apertures 84, 86.

Figure 4:
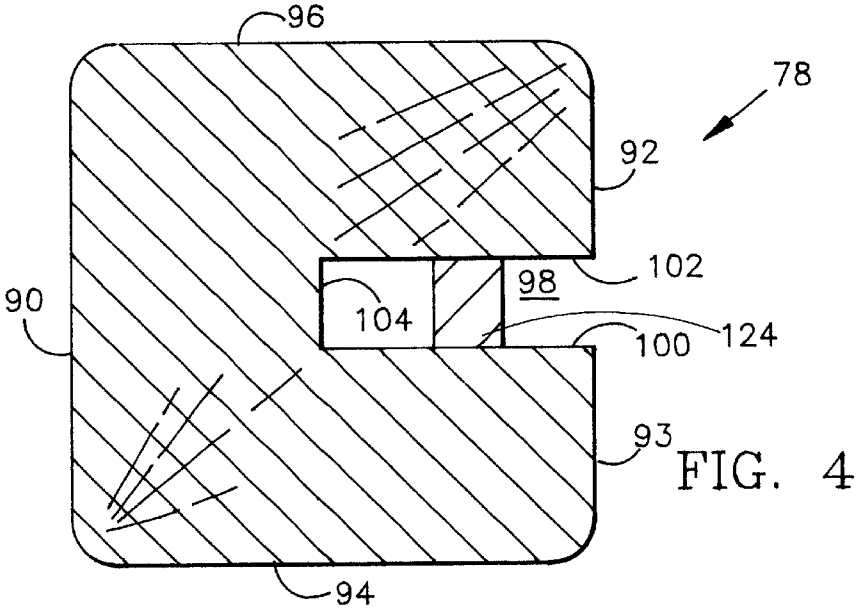
FIG. 4 is a sectional view of a post of a headboard taken generally along lines 4—4 of FIG. 3.

Turning now to FIGS. 3 and 4, the configuration of the bed posts will be explained in more detail. Although FIG. 4 is a sectional view of upper headboard bed post 78, each of the other seven (7) bed posts 50, 52, 62, 70, 72, 80, (not shown), will have a generally similar, if not identical configuration, although the bed posts, e.g., of footboards 22, 38, will be mirror images of the bed posts of headboards 20, 36.

Turning now to FIG. 4, bed post 78 is shown as being generally U-shaped in configuration, and includes an outboard surface 90, first and second inboard surface portions 92, 93, a front surface 94, and a rear surface 96. First and second inboard surface portions 92, 93 are separated by a space that defines a vertically extending channel 98, that preferably extends throughout most, if not the entire vertical length of bed post 78. The vertically extending, generally rectangular-in-cross-section channel 98, is defined by a first channel side surface 100, a second channel side surface 102 disposed in a plane generally parallel to that of first channel side surface 100, and a channel end surface 104 disposed in a plane generally perpendicular to the planes of the first and second channel side surfaces 100, 102.

A frame receiving pin 124 (FIG. 4) extends between first and second channel side surfaces 100, 102. Turning now to FIG. 3, it will be noticed that each of the four posts 50, 62, 70, 78 includes a vertical array of generally horizontally extending pins. As such, horizontally extending pin member 124 in post 78 is not alone, but rather is joined by a plurality of other, generally identical pins 124, arrayed vertically along channel 98, each pin 124 extends generally horizontally across the channel 98 of bed post 78. Similarly, a vertical array of generally horizontally extending pins 120 extend across the channel of first headboard post 62 of headboard 20 of lower bed assembly 16. A vertical array of generally horizontally extending frame receiving pins 122 extend across the channel of the footboard 22 of bed post 50; and a vertical array of similar, horizontally extending pins 126 extend across the channel of first post 70 of foot board 38 of upper bed assembly 16.

Although not shown in the figures, a similar, and preferably identical vertical arrays of frame engaging pins are formed in each of the other four bed posts of the present invention.

Referring to FIGS. 1 and 2, first mattress frame assembly 24, of first (lower) bed assembly 14 includes a first, L-shaped longitudinal frame rail 152, and a second, L-shaped longitudinal frame rail (not shown). Mattress frame assembly 24 further includes a first lateral frame rail 156 and a second lateral frame rail (not shown). Preferably, first and second longitudinal frame rails 152, (not shown) are identical, but rotated with respect to each other 180°, so that they appear as mirror images, when assembled onto first bed assembly 14. First and second lateral frame rails 156, (not shown) are also preferably identical, but rotated 180° with respect to each other.

A first parallelogram-type hinge mechanism 160 is coupled to first lateral frame rail 156, for hingedly coupling mattress support 28 to first lateral frame rail 156. Similarly, a second parallelogram-type hinge (not shown) is hingedly coupled between the second lateral frame rail (not shown) and mattress support 28, to hingedly couple mattress support 28 to the second lateral frame rail (not shown). Parallelogram hinges of this type are known in the futon art, and first and second parallelogram-type hinges 160, (not shown), should generally be constructed as mirror images of each other.

As also shown in FIG. 2, a first post-engaging plate 166 is coupled to first longitudinal frame rail 152, adjacent to first vertically disposed post 50 of footboard 22; and a second post-engaging plate 168 is coupled to first longitudinal frame rail 152, adjacent to vertically extending post 62 of headboard 20. As will be explained in more detail below, first and second post-engaging plates 166, 168 each include a pair of spaced pin-engaging hook members for engaging pins 122, 120, respectively, to bed frame 26 and selectively, removably attaching bed frame 26, and hence bed frame assembly 14 to footboard 22 and headboard 20, respectively. The pair of hooks of the first and second post-engaging plates 166, 168 are spaced apart by a vertical distance generally equal to the vertical distance at which the frame receiving pins 122, 120 are spaced, so that each of the two hooks on each of the two post-engaging plates 166, 168 will engage their own pin 122, 120. The interaction of the hooks with their respective pins is discussed later with reference to FIG. 8.

Third and fourth post-engaging plates 170, 172 are fixedly coupled to the ends of second longitudinal frame rail (not shown) for moveably, selectively coupling the second longitudinal frame rail to footboard 22 and headboard 20, respectively.

As best shown in FIGS. 1–3, and 5–10, the second (upper) mattress frame assembly 40 includes a bed frame 42. Bed frame 42 is constructed similarly, if not identically, to bed frame 26, and includes first and second longitudinal frame rails 192, 194 (FIGS. 9, 10), first and second lateral frame rails 196, 198, and first and second parallelogram-typed hinge mechanism 200, (not shown).

The second bed frame 42 also includes first and second post-engaging plates 206, 208 that are fixedly coupled to the respective first and second ends of the longitudinal frame member 192; and third and fourth post-engaging plates (not shown), 212 that are coupled, respectively to the first and second ends of the second longitudinal frame rail 194. The four post-engaging plates 206, 208, (not shown), 212 are generally similar, if not identical to their counterpart post-engaging plates 166, 168, (not shown), 172 of first frame 26.

Figure 5:
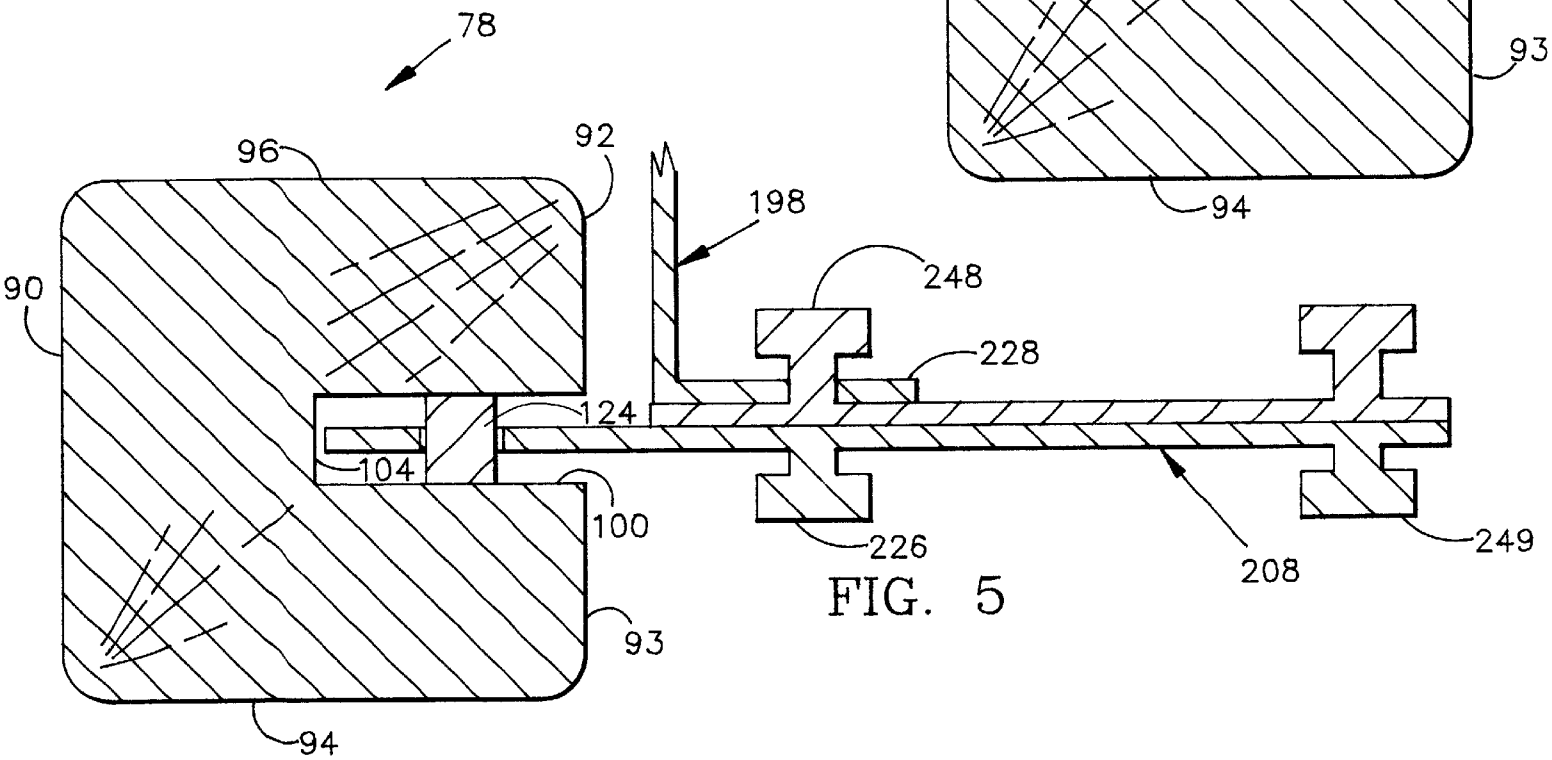
FIG. 5 is a sectional view, similar to FIG. 4 but taken along lines 5—5 of FIG. 3.
Figure 7:
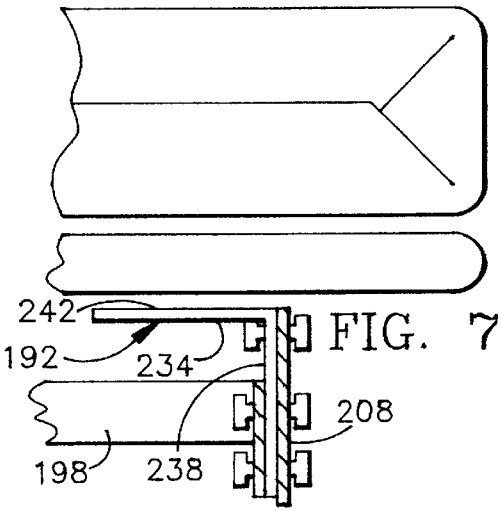
FIG. 7 is a sectional view taken generally along lines 7—7 of FIG. 6.
Figure 6:
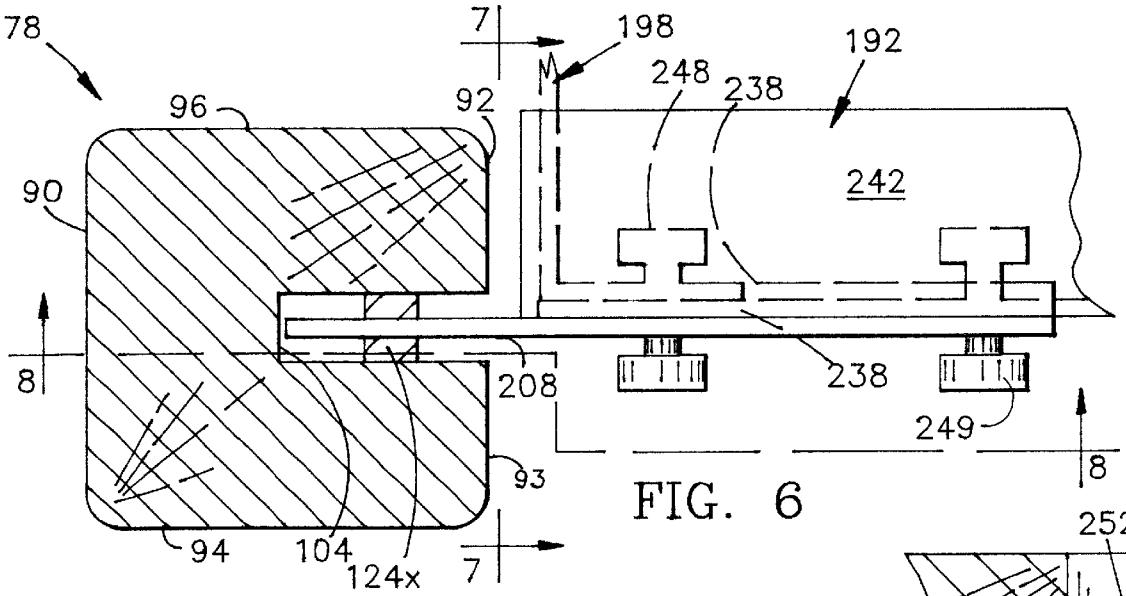
FIG. 6 is a sectional view, generally similar to FIGS. 4 and 5, but taken along lines 6—6 of FIG. 3.
Figure 9:
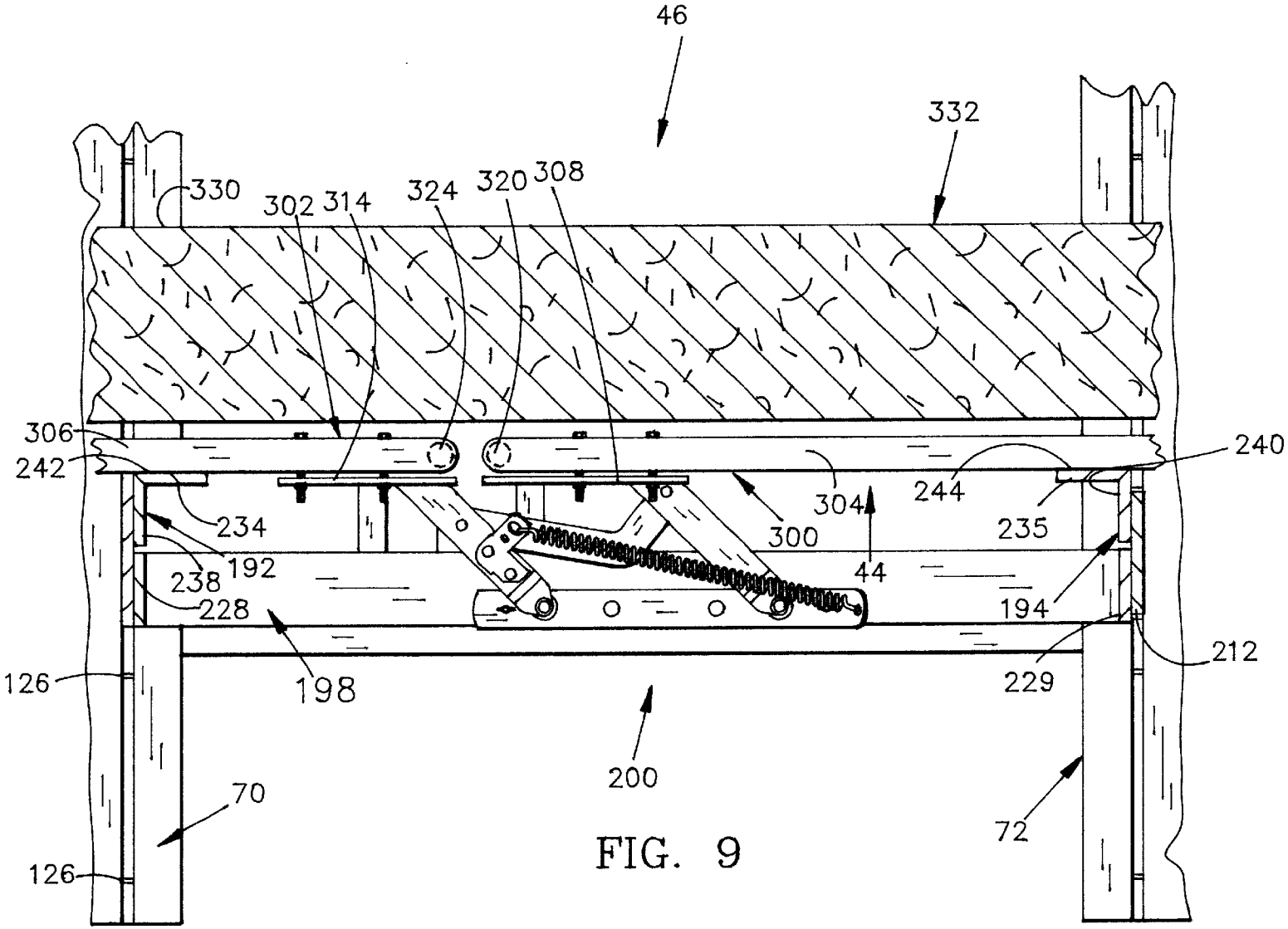
FIG. 9 is an enlarged, partly broken away side view illustrating the bed frame hinge assembly in its planar, or "bed" position.
Figure 10:
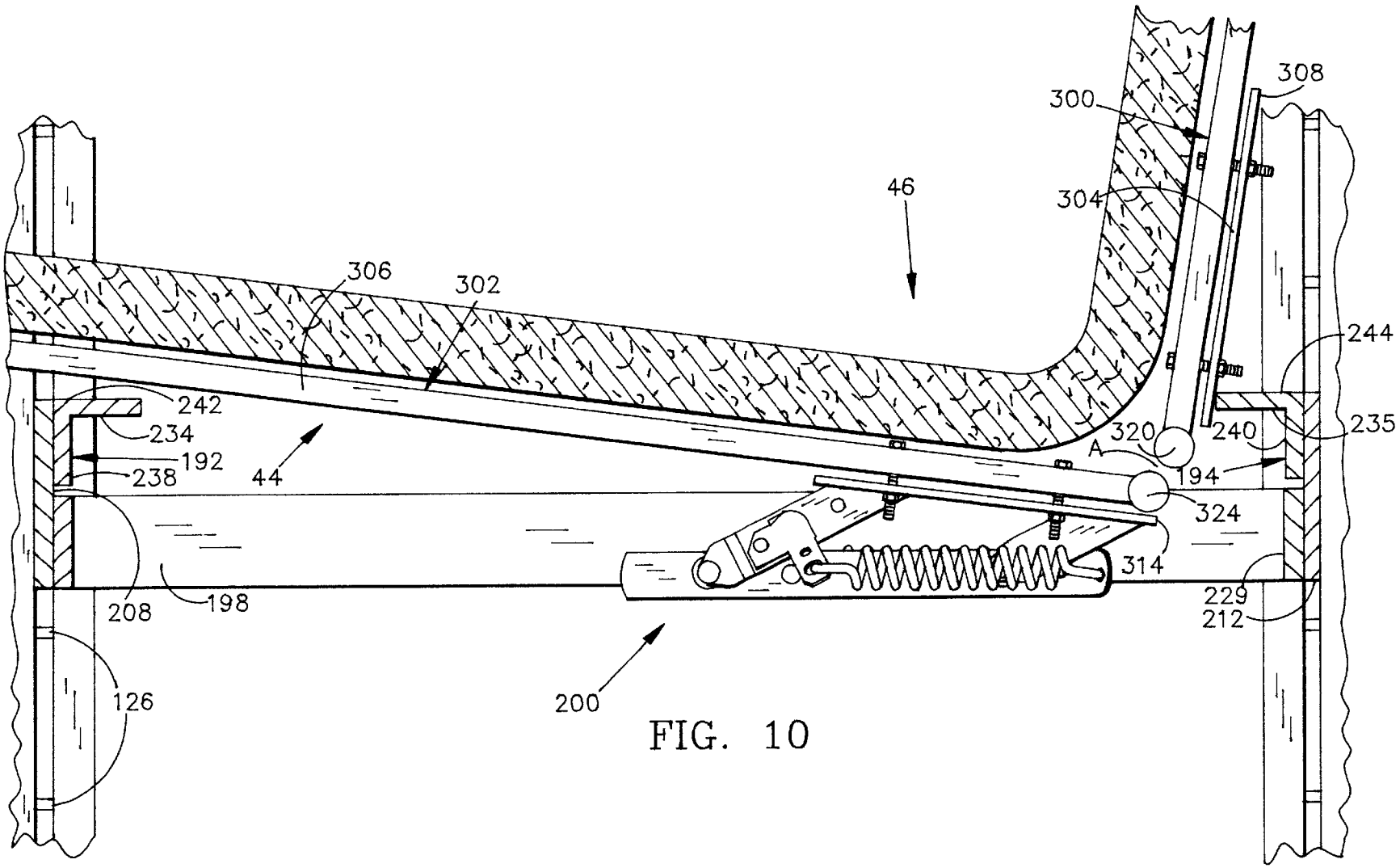
FIG. 10 is an enlarged side view showing the bed frame hinge in its angled or "couch" position.

Turning now to FIG. 5, second post-engaging plate 208 is coupled by bolts 226, 227 to a perpendicular flange 228 of second lateral frame rail 198. Referring to FIGS. 9 and 10, it will be noted that second lateral frame rail 198 also includes a rearwardly disposed perpendicular flange 229 that is coupled to fourth post-engaging plate 212. First lateral frame rail 196 is constructed generally similar to second lateral frame rail 198, but first lateral frame rail 196 is the mirror image thereof. Alternately, for ease of manufacture, first and second lateral frame rails 196, 198 can be identical, but rotated 180° with respect to each other, about the general longitudinal axis of lateral frame rails 196, 198.

Turning now to FIGS. 6, 7, 9, and 10, the first and second longitudinal frame rails 192, 194 are generally L-shaped. First longitudinal frame rail 192 includes a horizontally disposed leg 234 and a vertically disposed leg 238; and second longitudinal frame rail 194 also includes a horizontally disposed leg 235 and a vertically disposed leg 240. The respective horizontal legs 234, 235 of first and second longitudinal frame rails 192, 194 form a pair of mattress frame 44 support surfaces 242, 244, respectively, upon which mattress support 44 can rest when mattress support 44 and mattress 30 are in their planar, bed positions, as shown in FIG. 9.

Figure 8:
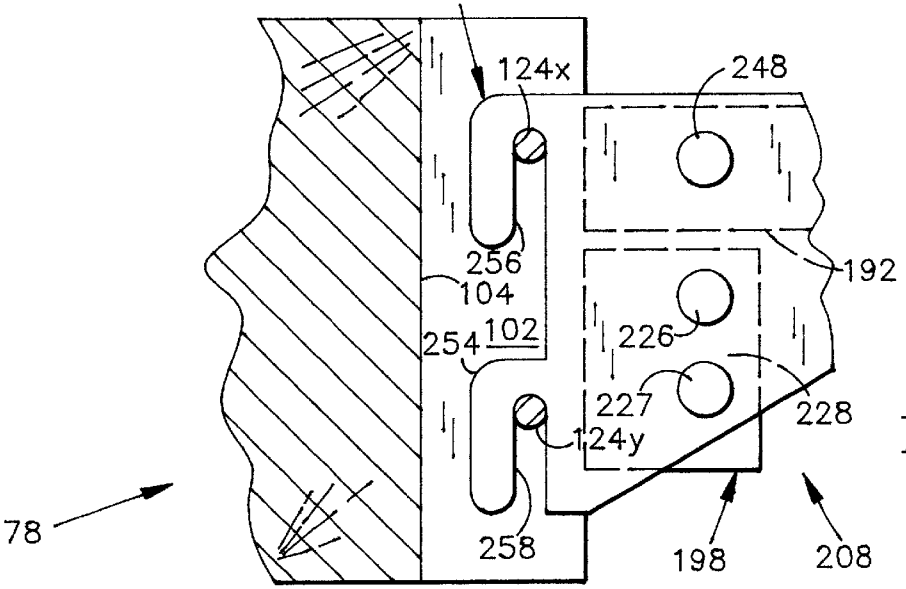
FIG. 8 is a greatly enlarged sectional view taken generally along lines 8—8 of FIG. 6.

Turning now to FIGS. 3 and 8, it will be noted that a pair of laterally spaced bolts 248, 249 extend through second, post-engaging plate 208, to fixedly couple first longitudinally extending frame rail 192 to second post-engaging plate 208. Post-engaging plate 208 includes a first (upper) pin-engaging hook 252, and a second (lower) pin-engaging hook 254. Each of first and second pin-engaging hooks 252, 254 contains an interiorly concavely arcuate underside surface 256, 258 respectively, for engaging the upper surface of pins 124*x*, 124*y* (FIG. 8). The vertical spacing between first and second hooks 252, 254 should be equal to the vertical spacing between two adjacent pins, e.g. pins 124*x*, 124*y*. Additionally, the gross height of each hook (as measured from the top of the hook to its lower most surface), should be less than the separation distance between adjacent pins, e.g. 124*x*, 124*y*, to permit hook 254 to be moved laterally between a pair of adjacent pins 124*x*, 124*y*.

It is preferred that the spacing between the hooks 252, 254 be constant for all of the post-engaging plates 166, 168, (not shown), 172 and 206, 208, (not shown), 212 such that posts 50, 52, 62, 70, 72, 78, 80, (not shown) can be interchanged, and such that the hooks of the frame-engaging plates will securely engage the posts of the headboard and footboard, regardless, for example, if second post-engaging plate 208 is engaged to footboard 38 or headboard 36.

Similarly, the vertical spacing between adjacent frame engaging pins, e.g. 124*x*, 124*y* should be constant among all of the sets of pins 120, 122, 124, 126 of two bed assemblies 14, 16.

Returning now to FIG. 3, lower frame 26 also includes an upper and lower pin-engaging hook 262, 264 that are fixedly coupled to first post-engaging plate 166; and an upper 268 and lower 270 pin-engaging hook fixedly coupled to second post-engaging plate 168.

Turning now to FIGS. 9 and 10, the configuration of mattress 46, mattress support 44 and parallelogram hinge 200 are shown in each of their planar or bed positions (FIG. 9) and in their couch positions (FIG. 10).

Turning first to FIG. 16, it will be noted that mattress support 44 is articulated, and includes a first mattress support section 300, and a second mattress support section 302, that are hingedly movable with respect to each other about axis A. First mattress support section 300 is constructed by using a first perimetral tube member 304 that extends generally around the perimeter of first mattress support section 300. Perimitral tube member 304 includes C-shaped first tube section 318 and generally linear second tube section 320. First and second plate members 308, 310 are provided for joining together C-shaped first tube section 318 and generally linear second tube section 320 of first perimetral tube member 304. A series of short coil springs, or a spring-like metal link system is connected to and disposed interiorly of the first perimetral tube member 304 for providing support to mattress 46 overlaying thereon, and in cooperation with mattress 46 for contributing to the softness of the bed.

Second mattress support section 302 is constructed similarly, but is a mirror image of first mattress support section 300. Second mattress support section 300 includes second perimetral tube member 306 having first and second tube sections 322, 324 coupled together by third and fourth plate members 314, 316. Short coil springs or a spring-like metal wire link system is interposed in the interior of tube member 306 defined by first and second tube sections 322, 324. The entire mattress support 44 is enclosed by a mattress support cover that preferably, encloses substantially the entire mattress support 44. The mattress support cover can be a single envelope for receiving the entire mattress frame, or alternately can be constructed into two separate sections, with the first section covering the first mattress support section 300 and the second section covering the second mattress support section 302.

Returning now to FIGS. 9 and 10, the action of the parallelogram hinge 200 is illustrated. When in its bed position, as shown in FIG. 9, mattress support 44 is moved relatively forwardly, and the parallelogram hinge mechanism 200 supports first and second mattress support section 302, 304 at the same height, and in a position wherein first and second mattress support sections 302, 304 are generally co-planar with each other, to cause the entire mattress support 44 to be generally planar, thus providing a planar surface upon which mattress 46 can rest. As mattress 46 is in a planar configuration, the first user engaging surface 330 of mattress 46 that overlays first mattress support section 302 is generally co-planar with second user engaging surface 332 of mattress 46 that overlays second mattress support section 304, thus providing a planar user engaging surface over the entire user engaging surface of mattress 46.

As also shown in FIG. 9, upper surfaces 242, 244 of the respective longitudinally extending rails 192, 194 provide a support surface upon which underside surface of respective first mattress support section 302 and second mattress support section 304 can rest, to provide additional support to mattress 46.

Turning now to FIG. 10, the mattress support 44 is shown in its angled or couch position. When in the couch position, it will be noted that first mattress support section 302 is placed at a generally perpendicular, but slightly obtuse angle to second mattress support section 304, as first and second mattress support sections 302, 304 have been hingedly moved with respect to each other by parallelogram hinge 200, about an axis defined generally by an axis A. Axis A comprises an imaginary line that runs parallel with, and is disposed between, tube sections 320, 324 of respective first and second perimetral tube member 304, 306.

Various exemplary configurations of the bunk bed will now be discussed with reference to FIGS. 11–15. The configurations shown in FIGS. 11–15 represent some (but not all) of the many different ways that bed 10 can be configured, and help to illustrate the flexibility of bed 10. It is important to remember that with the exception of desk 366, the components of bed 10 as shown in FIGS. 11–15 are essentially the same components shown and discussed in connection with FIGS. 1–10 and 16, and that these same components allow bed 10 to be configured in the various different ways shown in FIGS. 11–15.

Figure 11:
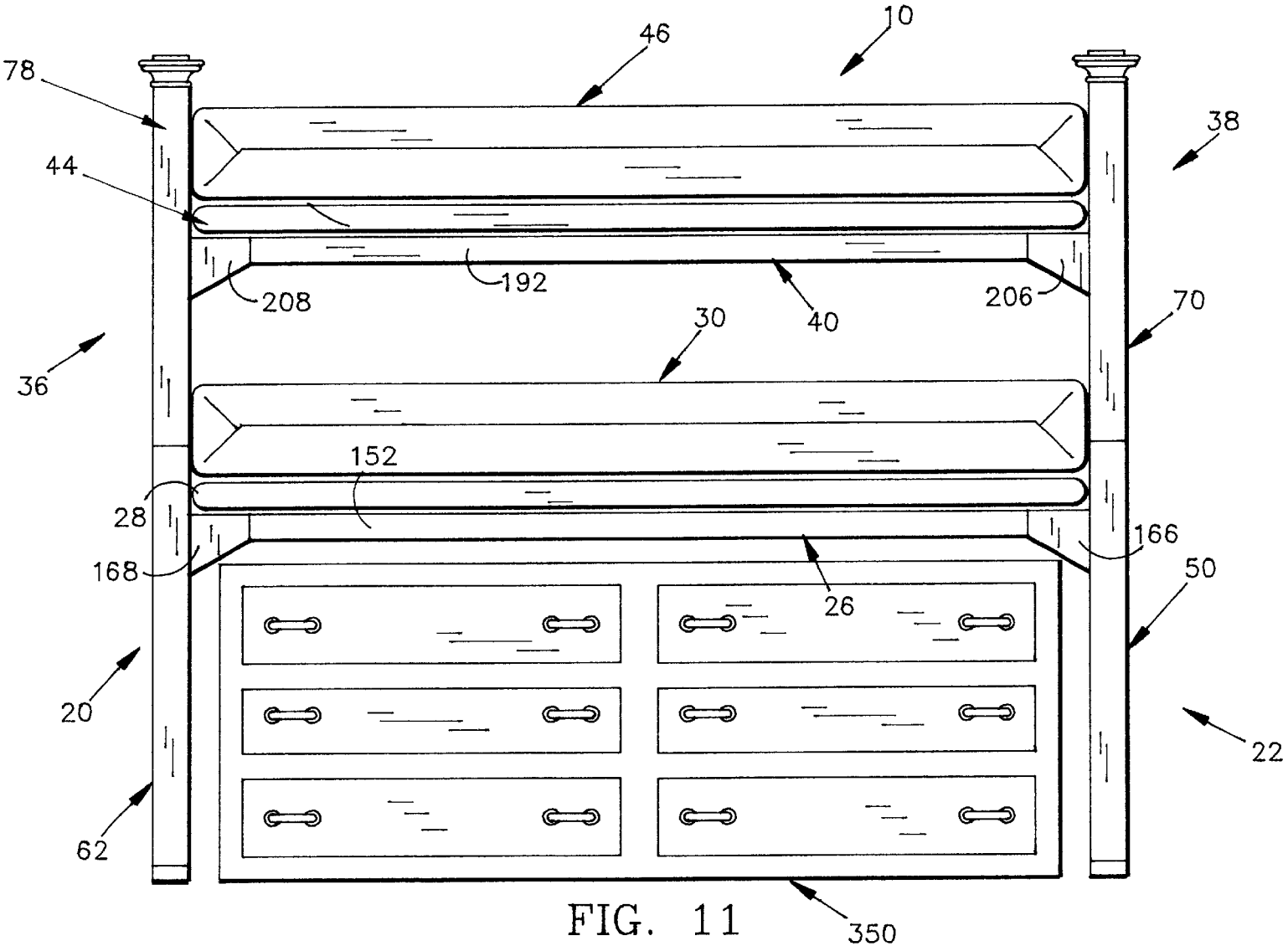
FIG. 11 is a front view of the bed of the present invention, showing the first and second bed frame assemblies positioned to provide sufficient room underneath the first bed assembly for the placement of a chest of drawers.

Turning now to FIG. 11, it will be noted that mattresses 30, 46 are both shown in their planar, bed positions. Further, first mattress frame 26 is illustrated as being attached to headboard 20 and footboard 22 at a relatively elevated position, almost, or at the top of the respective posts 50, 62. When so elevated, sufficient space exists underneath mattress frame assembly 24 to permit the user to place a low, chest of drawers 350 in the space underneath first mattress frame assembly 24. In this configuration, it should also be noted that second (upper) mattress frame assembly 40 is connected to second (upper) headboard 36 and footboard 38 in a relatively elevated position, to ensure that sufficient space exists between the underside of second mattress frame assembly 40 and the upper surface of lower mattress 30.

The configuration of bed 10, shown in FIG. 11, is one that offers many advantages, as it allows two mattresses 30, 46 and a chest of drawers 350 to occupy a space no larger than the space occupied by a normal twin bed. As such, the configuration shown in FIG. 11 has significant space-saving attributes. Nonetheless, some may not prefer the configuration shown in FIG. 11, as both lower mattress 30 and upper mattress 46 are placed in relatively elevated positions, thus requiring the users to perform some climbing in order to gain ingress to respective mattresses 30, 46.

Turning now to FIG. 12, it will be noted that both of lower mattress 30 and upper mattress 46 are placed in their couch configurations. Lower mattress frame assembly 24 is positioned relatively low, to place seat support surface 45 of mattress 30 at a height wherein a typical user sitting upon couch (mattress) 30 can sit comfortably, such as at the same general height as a conventional couch. Nonetheless, it will be noted that second mattress frame assembly 40 is placed in a relatively elevated position upon its headboard 36 and footboard 38, to place mattress 46 in an elevated position. One advantage of the configuration shown in FIG. 12, is that it maximizes space between lower mattress 30 and underside surface of upper mattress frame assembly 40.

Turning now to FIG. 13, bunk bed 10 of the present invention is shown in a configuration wherein first bed assembly 14 is separated from second bed assembly 16, with each of first and second bed assemblies 14, 16 being placed on the floor. Mattress 30 of first bed assembly 14 is shown in its planar, bed configuration, and mattress 46 of second bed assembly 16 is shown in its couch configuration. The configuration shown in FIG. 13 demonstrates a configuration that is appealing to students who do not enjoy climbing into the upper bunk of a bunk bed type configuration, as shown in FIGS. 1–12. An important thing to note about the configuration shown in FIG. 13, is that the configuration shown in FIG. 13 can be accomplished with the same components that also permit the bunk bed configuration shown in FIGS. 1–12.

Turning now to FIG. 14, bed 10 of the present invention is shown in its "stadium" seating configuration, that is especially useful when the user is entertaining a number of guests for watching a television 354 event, such as the Super Bowl. In the stadium seating configuration, bed frame 26 of the bed assembly 14 is placed in its relatively lower position on footboard 22 and headboard (not shown) so that mattress 30 is placed relatively close to the floor. Conversely, bed frame 42 of second bed assembly 16 is placed in a relatively higher position upon footboard 38 and headboard (not shown) to place mattress 46 of the second bed assembly 16 in a relatively elevated position. As will be noted, persons sitting on mattress 46 sit in a relatively elevated position, when compared to persons sitting on mattress 30. This enables persons sitting on mattress 46 to see over the heads of persons sitting on mattress 30, and thereby enable both persons sitting on mattress 30 and persons sitting on mattress 46 to have a clear field of view of television 354. It is believed that this feature will be especially popular with college student consumers, as college students enjoy gathering together a number of students to view television events.

Turning now to FIG. 15 an alternate embodiment bed 363 of the present invention is shown. By and large, most of the components shown in FIG. 15 are identical to their counterparts shown in the other drawings. Nothing in second bed assembly 16 is any different from bed assembly 16 shown in the other drawings, except with respect to the particular height at which bed frame assembly 42 is placed. Similarly, headboard 20 and footboard 22 are identical to headboards and footboards shown in the other drawings. The primary difference in bed 363 resides in the fact that bed frame 364, although very similar to bed frames 42 and 26 has been modified to accept a desk member 366 having an upper desk surface 367 upon which the user can place objects such as books 368, and a computer 370.

In bed system 363, frame 364 only needs to be modified slightly to accept desk member 366, rather than mattress 30. Primarily, the modification consists of the removal of the parallelogram hinges 200, 202 from a bed frame, such as bed frame 42, and the use of a different bracket and bolt system for fixedly coupling desk member 366 to bed frame 364. Preferably, desk member 366 is generally planar in configuration, and has a hard, planar upper surface 367 of wood or laminate, similar to other desks.

It will be noted that frame 364 has been coupled to headboard 20 and footboard 22 at a relatively elevated position thereon, to place desk member 366 at a proper height for facilitating work by the user thereon. When placed at its relatively raised height, desk member 366 and frame 364 are also sufficiently elevated off the ground to enable the user to place a short chest of drawers 372 under bed frame 364, along with desk chair 374. Headboard 20 and footboard 22 have sufficient height so desk chair 374 can be a standard desk chair that, when sat on by the user, will place upper desk surface 367 at a height where using desk surface 367, or computer 370 placed on desk surface 367 will be comfortable to the user.

As shown and described above, bed system 10 of the present invention provides a bed with a tremendous amount of flexibility, that enables the user to configure the bed in a manner that suits his needs and desires.

Although the invention has been described in detail with reference to certain preferred embodiments, variations and modifications exist within the scope and spirit of the present invention as described and defined in the following claims.

I claim:

1. A bunk bed assembly, comprising:

a first bed assembly, including a first headboard including a lower portion having first mating members and an upper portion having second mating members;

a first footboard including a lower portion having third mating members and an upper portion having fourth mating members;

a first support frame coupled to said first headboard and first footboard, said first support frame having a first mattress support member; and a second mattress support member pivotally coupled to said first mattress support member; and a first mattress disposed generally on said first mattress support member and said second mattress support member; and a second bed assembly removably coupled to said first bed assembly, including a second headboard including a lower portion having fifth mating members and an upper portion having sixth mating members;

a second footboard including a lower portion having seventh mating members and an upper portion having eighth mating members;

a second support frame coupled to said second headboard and second footboard, said second support frame having a third mattress support member; and a fourth mattress support member pivotally coupled to said third mattress support member; and a mattress disposed generally on said first second mattress support member and said fourth mattress support member.

2. The bunk bed assembly of claim 1, wherein said second bed assembly is coupled to said first bed assembly such that said second and fourth mating members on said first bed assembly are mated with said fifth and seventh mating members on said second bed assembly, thereby disposing said second bed assembly generally above said first bed assembly.

3. The bunk bed assembly of claim 1, wherein said second bed assembly is coupled to said first bed assembly such that said first and third mating members on said first bed assembly are mated with said sixth and eighth mating members on said second bed assembly, thereby disposing said second bed assembly generally below said first bed assembly.

4. The bunk bed assembly of claim 1, wherein said first bed assembly further includes a first support frame coupling member on said first headboard, a second support frame coupling member on said first footboard, a third coupling member on said first support frame for engaging said first support frame coupling member on said first headboard, and a fourth coupling member on said first support frame for engaging said second support frame coupling member on said first footboard; and wherein said second bed assembly further includes a fifth support frame coupling member on said second headboard, a sixth support frame coupling member on said second footboard, a seventh coupling member on said second support frame for engaging said fifth support frame coupling member on said second headboard and an eighth coupling member on said second support frame for engaging said sixth support frame coupling member on said second footboard.

5. The bunk bed assembly of claim 4, wherein said first bed assembly is in a couch position defined by said first mattress support member of said first bed assembly being generally angled relative to said second mattress support member of said first bed assembly and wherein said second bed assembly is in a couch position defined by said first mattress support member of said second bed assembly being generally angled relative to said second mattress support member of said second bed assembly.

6. The bunk bed assembly of claim 5, wherein said first bed assembly and said second bed assembly are uncoupled and are in a stadium seating arrangement wherein said first bed assembly is generally forward of said second bed assembly, wherein said first support frame of said first bed assembly is coupled near the lower portion of said first headboard and first footboard of said first bed assembly; and wherein said second support frame of said second bed assembly is coupled near the upper portion of said second headboard and second footboard of said second bed assembly.

7. The bunk bed assembly of claim 2, wherein said first bed assembly is in a couch position defined by said first mattress support member of said first bed assembly being generally angled relative to said second mattress support member of said first bed assembly and wherein said second bed assembly is in a bed position defined by said third mattress support member of said second bed assembly being generally co-planar to said fourth mattress support member of said second bed assembly.

8. The bunk bed assembly of claim 1, wherein said first support frame of said first bed assembly is coupled to said upper portion of said first headboard and first footboard of said first bed assembly and wherein said bunk bed assembly further comprises a chest of drawers disposed beneath said first support frame of said first bed assembly and between said first headboard and said first footboard of said first bed assembly.

9. A bunk bed assembly, comprising:

a first bed assembly, including a first headboard including a lower portion having first mating members and an upper portion having second mating members;

a first footboard including a lower portion having third mating members and an upper portion having fourth mating members;

a first support frame coupled to said first headboard and first footboard, said support frame having a first mattress first support member; and a second mattress first support member pivotally coupled to said first mattress support member; and a mattress disposed generally on said first mattress support member and said second mattress support member; and a second bed assembly removably coupled to said first bed assembly, including a second headboard including a lower portion having fifth mating members and an upper portion having sixth mating members;

a second footboard including a lower portion having seventh mating members and an upper portion having eighth mating members;

a desktop coupled to said second headboard and second footboard.

10. The bunk bed assembly of claim 9, wherein said sixth and eighth mating members of said second bed assembly are mated with said first and third mating members of said first bed assembly such that said first bed assembly is disposed generally above said second bed assembly.

11. The bunk bed assembly of claim 10, wherein said bunk bed assembly further comprises a set of drawers disposed below said desktop and between said second headboard and said second footboard of said second bed assembly.

* * * * *